United States Patent [19]

Quillmann et al.

[11] Patent Number: 4,472,347

[45] Date of Patent: Sep. 18, 1984

[54] CONTAINER FOR THE LONG TIME STORAGE OF RADIOACTIVE MATERIALS

[75] Inventors: Heinrich Quillmann, Nidderau; Hans-Jörg Wingender, Mömbris-Dörnsteinbach, both of Fed. Rep. of Germany

[73] Assignee: Nukem GmbH, Hanau, Fed. Rep. of Germany

[21] Appl. No.: 381,875

[22] Filed: May 25, 1982

[30] Foreign Application Priority Data

Jun. 5, 1981 [DE] Fed. Rep. of Germany ..... 3122328

[51] Int. Cl.[3] ..... G21F 5/00; G21C 19/32

[52] U.S. Cl. ..... 376/272; 136/202; 204/148; 204/197; 250/506.1; 252/633

[58] Field of Search ..... 204/148, 197; 250/506.1, 507.1; 252/633; 376/272, 305; 136/202

[56] References Cited

U.S. PATENT DOCUMENTS

| | | | |
|---|---|---|---|
| 3,016,463 | 1/1962 | Needham | 250/506.1 |
| 3,758,346 | 9/1973 | Falkenberg et al. | 136/202 |
| 3,902,973 | 9/1975 | Gomes | 204/1.5 |
| 4,192,765 | 3/1980 | Bird et al. | 250/507.1 X |
| 4,376,753 | 3/1983 | Lucas | 376/305 |

OTHER PUBLICATIONS

Nero, A Guidebook to Nuclear Reactors, Univ. of Calif. Press, Los Angeles, 1979, pp. 178 and 179.

*Primary Examiner*—Leland A. Sebastian

*Attorney, Agent, or Firm*—Cushman, Darby & Cushman

[57] ABSTRACT

There is described a container for the long time storage of radioactive materials, especially spent fuel elements, in suitable geological formations which guarantees an intact barrier for a long period of time even in the event of intrusion or access of water and brine. The container is provided with a cathodic corrosion protection whereby an isotope battery serves as the source of direct current. The radioactive stored materials is used as the source of energy.

22 Claims, 1 Drawing Figure

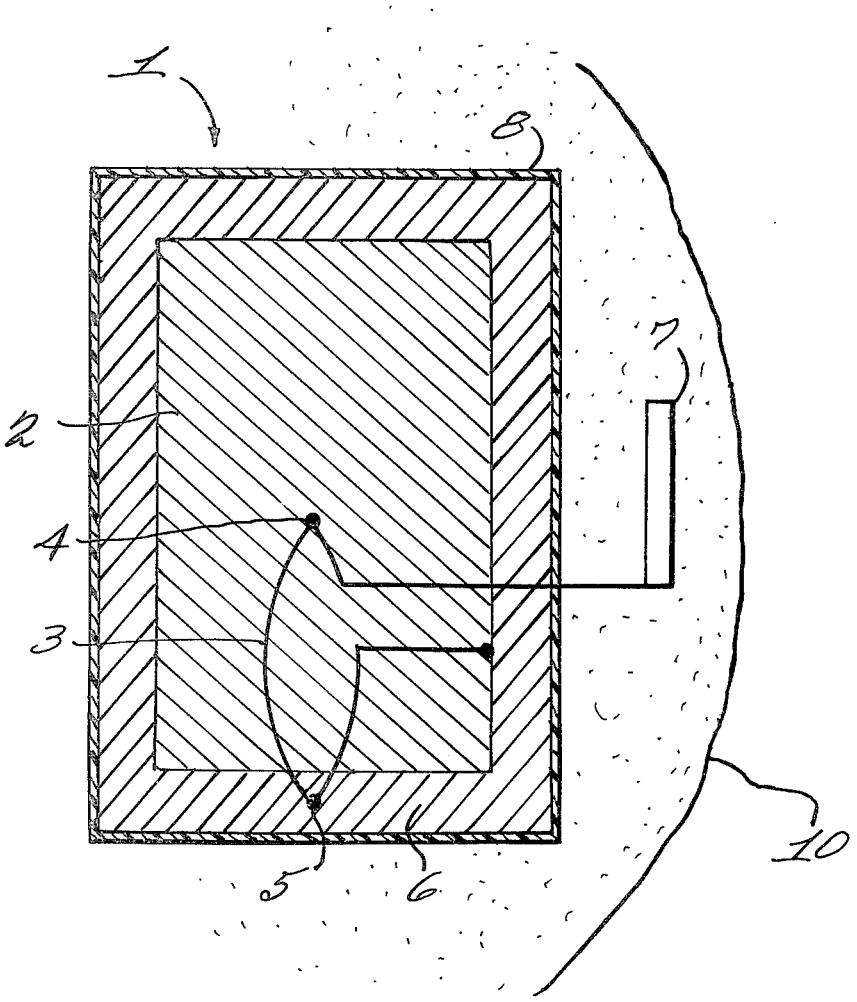
1
2
3
4
5
6
7
8
10

CONTAINER FOR THE LONG TIME STORAGE OF RADIOACTIVE MATERIALS

BACKGROUND OF THE INVENTION

The subject matter of the invention is a container for the long time storage of radioactive materials, especially spent fuel elements, in suitable geological formations which has cathodic protection provided by a direct current source connected to an anode.

Spent fuel elements after a temporary storage in water basins are either immediately or after a limited further intermediate storage reprocessed. Thereby, the nuclear fuel and breeded materials are separated from the fission products and again recycled to the fuel cycle. The fission products according to known processes are conditioned, for the most part using large amounts of valuable materials, as for example, lead and copper and are finally disposed of in a non-retrievable manner in suitable geological formations such as salt domes or bedded salt.

Futhermore, there has been considered (reports of the Kernforschungszentrum Karlsruhe KFK 2535 and 2650) to not reprocess the irradiated fuel elements in the foreseeable future, to give up the fuel and breeded materials in them and, after a suitable decay time in interim storages to finally dispose of the fuel elements in repositories in salt formations. The storage period of the spent fuel elements in the repository thus may last up to hundreds of years and more.

Because of the undetermined storage time, there are placed special requirements on such containers suited for long term storage and final disposal. Increasing the difficulty is the fact that the container repository must be inaccessible and, consequently, the possibilities of supervision are limited or even zero.

There are designs—partly rather expensive and sophisticated—to store the spent fuel elements or radioactive waste by means of containers made of metal or concrete in geological formations as, e.g., in dry salt formations (Report of the Kernforschungszentrum Karlsruhe KFK 3000).

However, the use of concrete is problematical since long time experience over hundreds or even over thousands of years is of course not obtainable. Metal containers, e.g., of steel, cast iron, especially spherical graphite cast iron, lead, copper, or other materials have disadvantages too. Among others, these are partially in the production costs, above all, however, in the area of corrosion, since among others water intrusions, even though there is only a slight possiblity of occurrence, must be included in safety considerations of industrial safety.

For the long term storage of spent fuel elements and other radioactive materials there have already been proposed single or multiple layer containers of various steels, in part with coatings of titanium, zirconium, or other materials, of copper or corundum. These containers, however, are either very expensive or not sufficiently resistant to corrosion. In the case of containers made of corundum, there is still a lack of production experience.

There has already been proposed (German OS No. 31 03 558 and related Holtmann U.S. application Ser No. 344,966 filed Feb. 2, 1982, the entire disclosure of the Holtmann U.S. application being incorporated by reference and relied upon) to provide the protection against corrosion of containers for the long term storage of radioactive materials by means of sacrificial anodes, in which case the anodes in the presence of an electrolyte are consumed in the course of time. It is also known to protect objects in corrosive media cathodically by connecting the object to be protected with an anode and a source of direct current.

The invention, therefore, is based on the problem of providing a container for the long term storage of radioactive materials, especially spent fuel elements, in suitable geological formations with cathodic protection by a direct current source connected with an anode, which guarantees an intact barrier for a long period of time even in case of intrusion of water or brine, without maintenance and inspection.

SUMMARY OF THE INVENTION

This problem was solved according to the invention by using as the source of direct current one or more isotope batteries.

The containers are protected cathodically against corrosion by forming an electrochemical macroelement consisting of an external electrode and of the container, which represents the cathode. In order to prevent a destruction of the electronegative anode by corrosion, there is used a source of direct current which maintains the superimposed protective current in such manner that it always has a higher voltage than occurring micro or macroelements. By this means there exists a voltage compensation of the local elements which are formed by the contact of the container metal with the humidity in the ambiency. According to the invention, there serve as the source of direct current one or more isotope batteries in which the electrical energy is generated by the decay energy of radioactive nuclides whereby either the decay heat is directly transformed or the decay radiation after conversion into visible light by means of photoelements is transformed into electrical energy. Preferably, the radioactive material stored in the containers serves as the energy source for the isotope battery.

Advantageously for the direct conversion, there is used a thermocouple whose hot junction is arranged as centrally as possible in the hot region of the stored material. The cold junction is either placed within the storage container at the relatively cold outer surface or the thermocouple is led outside the container and the cold junction installed in the medium outside the container. Arrangement of the cold junction in the cooled jacket of the container has also proven satisfactory. There can be used for the thermocouple wires made of iron/Constantan, copper/Constantan, nickel/chromium-nickel, platinum/platium-rhodium, gold/silver, gold-cobalt/silver-gold, lead/tellurium, etc. Thereby, the selection is dependent upon the necessary thermoelectric voltage and the necessary resistance to corrosion. The region in which the hot junction is arranged can be additionally insulated in order to have an especially high temperature at this place, in order that correspondingly high thermocurrents flow. For the production of especially high voltages, several thermocouples can also be connected in series. In the indirect conversion so-called luminous substance, commonly zinc sulfide activated with silver is applied to photo elements. The luminous material transforms the radioactive radiation into visible light which is directly converted into an electrical current in a photo cell. Here also, it is possible to connect several elements in series to increase the voltage. Of course, in principle it is also possible to use other methods than the two systems mentioned for the production of electrical energy from the decay energy of the radioactive nuclides. Advantageously, graphite can be used as the anode material as it is extraordinarily resistant to corrosion.

The arrangement of the invention especially protects containers which are provided with electrically non-conducting coatings since then only those spots are to be protected at which there are pores through which the corrosive medium can get to the metal.

Substantial advantages of the invention are the small expense, the large effectiveness, and especially the long time protection which extends until the radioactive decay and therewith the production of heat are substantially decayed. This means the long time protection continues until the radioactivity of the stored material does not further present danger.

The combination can comprise, consist essentially of, or consist of the elements set forth.

BRIEF DESCRIPTION OF THE DRAWING

The single FIGURE of the drawing shows schematically an illustrative form of the invention.

DETAILED DESCRIPTION

Referring more specially to the drawing, there is located in container 1, e.g., made of a metal such as iron, the radioactive material 2 to be stored and an isotope battery 3, in this case a thermoelement whose hot junction 4 is located within the container, in the radiation region the stored material, while the cold junction 5 is arranged in the jacket 6 of the container. The thermoelement 3 is electrically connected with the container jacket 6 and an anode 7 which is located outside the container 1. The outer surface of the container can have a non-conducting coating 8 thereon.

The entire device can be placed in a geological formation such as a salt formation.

What is claimed is:

1. A combination comprising a container for the long time storage of radioactive material in a suitable geological formation and having cathodic protection and wherein the cathode is connected with an anode by a source of direct current, said direct current source comprising at least one isotope battery and said container having radioactive material therein which radioactive material serves as the energy source for the isotope battery.

2. A combination according to claim 1 wherein the container is made of a conductive material and serves as a cathode.

3. A combination according to claim 2 in place in a geological formation.

4. A combination according to claim 3 wherein the geological formation is a salt formation.

5. A combination according to claim 3 wherein the isotope battery has at least one thermoelement.

6. A combination according to claim 1 wherein the isotope battery has at least one thermoelement.

7. A combination according to claim 1 wherein the thermoelement comprises a metallic thermocouple.

8. A combination according to claim 5 wherein the thermolement comprises a metallic thermocouple.

9. A combination according to claim 5 wherein the thermoelement comprises a thermocouple, said container has a jacket, the thermocouple has its hot junction within the container and its cold junction in the jacket.

10. A combination according to claim 6 wherein the thermoelement comprises a thermocouple, said container has a jacket, the thermocouple has its hot junction within the container and its cold junction in the jacket.

11. A combination according to claim 10 wherein the anode is made of graphite.

12. A combination according to claim 9 wherein the anode is made of graphite.

13. A combination according to claim 3 wherein the anode is made of graphite.

14. A combination according to claim 2 wherein the anode is made of graphite.

15. A combination according to claim 1 wherein the anode is made of graphite.

16. A combination according to claim 11 wherein the container has a non-conductive coating on its outer surface.

17. A combination according to claim 10 wherein the container has a non-conductive coating on its outer surface and the container is made of a conductive material.

18. A combination according to claim 9 wherein the container has a non-conductive coating on its outer surface.

19. A combination according to claim 5 wherein the container has a non-conductive coating on its outer surface.

20. A combination according to claim 1 wherein the container has a non-conductive coating on its outer surface and the container is made of a conductive material.

21. A combination according to claim 3 wherein the container has a non-conductive coating on its outer surface.

22. A combination according to claim 2 wherein the container has a non-conductive coating on its outer surface.

* * * * *